US008507164B2

(12) United States Patent
Iwazaki et al.

(10) Patent No.: US 8,507,164 B2
(45) Date of Patent: Aug. 13, 2013

(54) YELLOW TONER, DEVELOPING AGENT, TONER CARTRIDGE, PROCESS CARTRIDGE, IMAGE FORMING APPARATUS AND IMAGE FORMING PROCESS

(75) Inventors: Eisuke Iwazaki, Kanagawa (JP); Satoshi Yoshida, Kanagawa (JP); Shinya Sakamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 90 days.

(21) Appl. No.: 13/019,694

(22) Filed: Feb. 2, 2011

(65) Prior Publication Data

US 2012/0077117 A1 Mar. 29, 2012

(30) Foreign Application Priority Data

Sep. 24, 2010 (JP) ..... 2010-214294

(51) Int. Cl.
*G03G 9/00* (2006.01)

(52) U.S. Cl.
USPC ..... 430/105; 399/111; 399/252

(58) Field of Classification Search
USPC ..... 430/105; 399/111, 252
See application file for complete search history.

(56) References Cited

U.S. PATENT DOCUMENTS

| | | | | |
|---|---|---|---|---|
| 2005/0112492 | A1 | 5/2005 | Makino et al. | |
| 2007/0048646 | A1* | 3/2007 | Sasaki et al. | 430/109.4 |
| 2008/0261141 | A1 | 10/2008 | Yasukawa et al. | |
| 2009/0239171 | A1 | 9/2009 | Anno et al. | |
| 2009/0239174 | A1* | 9/2009 | Inaba et al. | 430/112 |
| 2009/0245858 | A1* | 10/2009 | Mizutani et al. | 399/111 |

FOREIGN PATENT DOCUMENTS

| | | |
|---|---|---|
| JP | A-2002-341594 | 11/2002 |
| JP | A-2005-258394 | 9/2005 |
| JP | A-2006-313302 | 11/2006 |
| JP | A-2008-287239 | 11/2008 |
| JP | A-2009-204774 | 9/2009 |
| JP | A-2009-258681 | 11/2009 |
| JP | A-2009-300733 | 12/2009 |

OTHER PUBLICATIONS

Oct. 5, 2012 Office Action issued in U.S. Appl. No. 13/224,969.
U.S. Appl. No. 13/352,786 filed Jan. 18, 2012.
U.S. Appl. No. 13/224,969 filed Sep. 2, 2011.
Mar. 25, 2013 Office Action issued in U.S. Appl. No. 13/352,786.

* cited by examiner

*Primary Examiner* — Mark F Huff
*Assistant Examiner* — Rachel Zhang
(74) *Attorney, Agent, or Firm* — Oliff & Berridge, PLC

(57) ABSTRACT

The invention provides a yellow toner including toner particles comprising colorants and a binder resin, the colorants including at least a C. I. Pigment yellow 180 and a carmine-based pigment, a weight ratio of the C. I. Pigment yellow 180 to the carmine-based pigment being from about 99:1 to about 10,000:1, the binder resin being a polyester resin comprising a first repeating unit derived from a first diol compound, and the first diol compound being a bisphenol A ethylene oxide represented by the following formula (1):

Formula (1)

wherein in formula (1), m and n each independently represent an integer of from 2 to 4.

19 Claims, 3 Drawing Sheets

YELLOW TONER, DEVELOPING AGENT, TONER CARTRIDGE, PROCESS CARTRIDGE, IMAGE FORMING APPARATUS AND IMAGE FORMING PROCESS

CROSS-REFERENCE TO RELATED APPLICATIONS

This application is based on and claims priority under 35 USC 119 from Japanese Patent Application No. 2010-214294 filed on Sep. 24, 2010.

BACKGROUND

1. Technical Field

The present invention relates to a yellow toner, a developing agent, a toner cartridge, a process cartridge, an image forming apparatus and an image forming process.

2. Related Art

A process for visualizing image information by forming an electrostatic latent image and developing the image such as an electrophotographic process is now utilized in various fields. Formation of an image by this process is performed by charging the whole surface of a photoreceptor (latent image holding member), exposing the surface of the photoreceptor with laser light that corresponds to image information to form an electrostatic latent image, then developing the electrostatic latent image with a developing agent including a toner to form a toner image, and finally transferring and fixing the toner image on the surface of a recording medium.

The toner used for the electrophotographic process is generally prepared by a kneading-pulverizing process including melt-kneading a plastic resin together with a pigment, a charge controlling material, a release agent, a magnetic substance and the like, and cooling, micropulverizing and further classifying the product.

SUMMARY

According to an aspect of the present invention, there is provided a yellow toner including toner particles comprising colorants and a binder resin, the colorants including at least a C. I. Pigment yellow 180 and a carmine-based pigment, a weight ratio of the C. I. Pigment yellow 180 to the carmine-based pigment being from about 99:1 to about 10,000:1, the binder resin being a polyester resin comprising a first repeating unit derived from a first diol compound, and the first diol compound being a bisphenol A ethylene oxide represented by the following formula (1):

Formula (1)

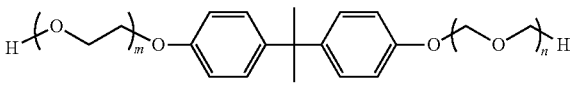

wherein in formula (1), m and n each independently represent an integer of from 2 to 4.

BRIEF DESCRIPTION OF THE DRAWINGS

Exemplary embodiments of the present invention will be described in detail, based on the following figures, wherein.

DETAILED DESCRIPTION

Figure 1:
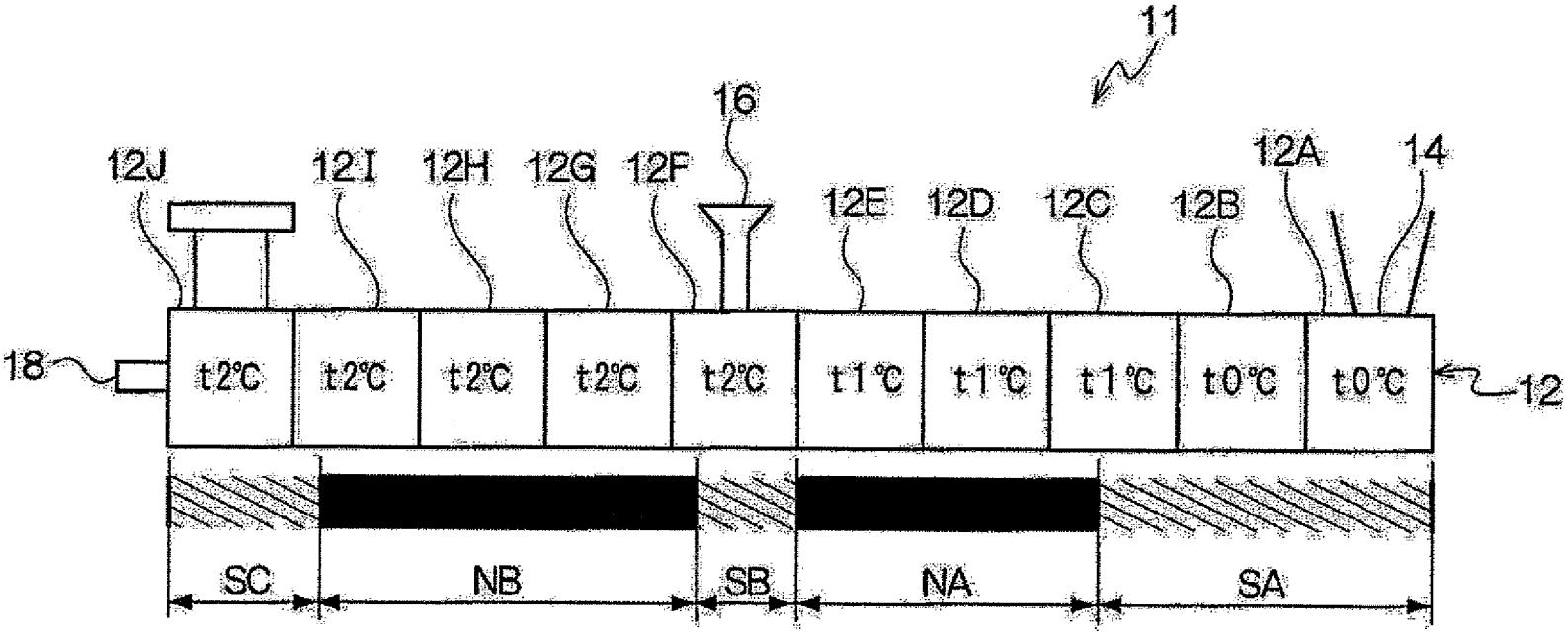
FIG. 1 is a drawing that explains the state of a screw in an example of a screw extruder for use in the preparation of the yellow toner of the present exemplary embodiment.

Hereinafter the exemplary embodiments of the yellow toner, developing agent, toner cartridge, process cartridge, image forming apparatus and image forming process of the present invention are explained in detail.

<Yellow Toner>

The yellow toner of the present exemplary embodiment (hereinafter sometimes abbreviated as the toner of the present exemplary embodiment) includes toner particles including colorants and a binder resin, wherein the colorants are C. I. Pigment yellow 180 and a carmine-based pigment, the weight ratio of the C. I. Pigment yellow 180 to the carmine-based pigment is from 99:1 or about 99:1 to 10,000:1 or about 10,000:1, and the binder resin is a polyester resin including repeating units derived from a bisphenol A ethylene oxide represented by the following formula (1):

Formula (1)

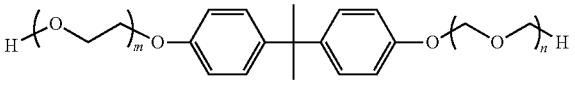

wherein m and n each independently represent an integer of from 2 to 4 in the formula (1).

The reason why the reproducibility of a flesh color image is improved by using the toner of the present exemplary embodiment is assumed to be based on the following reason.

A flesh color image is obtained by superposing color toners in the order of a yellow toner, a magenta toner and a cyan toner on an intermediate transfer body such as an intermediate transfer belt to form a superposed toner image, and transferring the superposed toner image onto a recording medium and fixing the image thereon. In the past, during formation of a flesh color image, redness of the flesh color was specifically strong and color reproducibility was decreased in some cases. The cause of strong redness includes a phenomenon in which the superposed toner image is degraded during fixing of the toner image, whereby the magenta toner transfers to an unintended position. Degradation of the superposed toner image is assumed to be attributed to weak adhesion between the yellow toner and the magenta toner that are laminated on the intermediate transfer body. The magenta toner transferred to the unintended position not only enhances redness of the fixed image, but also decreases halftone formability and tends to provide a dingy color.

In the present exemplary embodiment, the adhesion between the yellow toner and the magenta toner is improved by providing the yellow toner with the above composition. As a result, it is supposed that transfer of the magenta toner laminated on the yellow toner to the unintended position due to degradation of the superposed toner image is suppressed, whereby the reproducibility of a flesh color image is improved.

In the present exemplary embodiment, a toner including a carmine-based pigment as a colorant is desirable as the magenta toner that is used in combination with the toner of the present exemplary embodiment during formation of a flesh color image.

Hereinafter the composition of the toner of the present exemplary embodiment is explained.

The toner of the present exemplary embodiment includes toner particles including colorants and a binder resin, and may include external additives where necessary.

—Colorants—

In the present exemplary embodiment, C. I. Pigment yellow 180 and a carmine-based pigment are used in combination as colorants. By using C. I. Pigment yellow 180 that is a disazo pigment as a colorant, adhesion with the magenta toner including the carmine-based pigment is improved, whereby the reproducibility of a flesh color image is improved. Furthermore, by adding the carmine-based pigment that exhibits magenta color to the toner of the present exemplary embodiment, adhesion with the magenta toner is improved, whereby the reproducibility of a flesh color image is improved.

In present exemplary embodiment, the weight ratio of the C. I. Pigment yellow 180 to the carmine-based pigment is adjusted to 99:1 or about 99:1 to 10,000:1 or about 10,000:1. When the ratio of the C. I. Pigment yellow 180 is lower than 99:1, redness tends to be strengthen, whereby the reproducibility of a flesh color image may be decreased. On the other hand, when the ratio of C. I. Pigment yellow 180 is more than 10,000:1, the adhesion of the yellow toner to the magenta toner is decreased, whereby the yellow toner transfers easily, and the reproducibility of a flesh color image may decrease. The weight ratio of the C. I. Pigment yellow 180 to the carmine-based pigment is more preferably 1000:1 or about 1000:1 to 2500:1 or about 2500:1.

Specific examples of the carmine-based pigment used in the present exemplary embodiment include Naphthol Carmine FB, Naphthol Carmine FSB, Brilliant Carmine 6B, Brilliant Carmine 3B, Brilliant Carmine 13S, and Benzimidazolone Carmine HF4C.

The colorants need to include the C. I. Pigment yellow 180 and a carmine-based pigment.

The C. I. Pigment yellow 180 that is a colorant that has a bulky molecular structure, is hydrophobic and has many covalent electron pairs. On the other hand, the carmine colorant is also bulky since it has a naphthol group, is highly hydrophobic, and has a sulfonyl group that repels the covalent electron pairs of the C. I. Pigment yellow 180; therefore, it hardly coagulates in the toner but disperses easily. Therefore, adhesion to the magenta toner becomes even during image formation. In order to improve the reproducibility of a flesh color, the C. I. Pigment yellow 180 and a carmine-based pigment need to be included as colorants in the present exemplary embodiment.

The total amount of the colorants included in the toner particles of the present exemplary embodiment is preferably a ratio of from 1 part by weight or about 1 part by weight to 20 parts by weight or about 20 parts by weight with respect to 100 parts by weight of the binder resin.

The amount of PY180 colorant, the amount of the carmine colorant and the ratio of the amount of PY180/the amount of carmine may be calculated by a process for detecting the C. I. Pigment yellow 180 and the carmine-based pigment in the toner including extracting a toluene-insoluble component in the toner, measuring the weight, and performing IR and fluorescence X-ray analyses and an NMR analysis.

Alternatively, the weight ratio of the C. I. Pigment yellow 180 to the carmine-based pigment may also be measured by the following process.

Ionization of the THF-insoluble component in the toner by direct laser irradiation is performed by Laser Desorption/Ionization (LDI).

More specifically, 1 g of the toner is dissolved in THF, filtered, and the filtered component is dried. The filtered component is pound in a mortar and suspended in a solution of THF/MeOH (1/1) to give a sample.

Using an MS section of an ion trap-type GC-MS (trade name: POLARIS Q, manufactured by Themo Fisher) as a measurement device, and using a direct sample introduction process, a weight analysis is performed under the following analysis conditions.

Conditions for analysis:

GC-MS: POLARIS Q

Ion Source Temp: 200° C.

Electron Energy: 70 eV

Emission Current: 250 μA

Weight Range: m/z 50-1000

Reagent Gas: Methane

Direct sample Probe (DEP)

Rate: 20 mA (10 sec)-5 mA/sec-1000 mA (30 sec)

A pigment ratio is calculated from the peak ratio of the weight of PY180: 706 to the weight of Carmine 6B: 424.1.

—Binder Resin—

In the present exemplary embodiment, a polyester resin including a repeating unit derived from the bisphenol A ethylene oxide represented by the formula (1) is used as a binder resin. The polyester resin would be obtained by polymerizing a dicarboxylic acid and a dial as polymerizable monomers. The bisphenol A ethylene oxide represented by the formula (I) is used as the diol component of the polyester resin.

By using the bisphenol A ethylene oxide represented by the formula (1) as the diol component of the polyester resin, the dispersing property of the carmine-based pigment included in the toner of the present exemplary embodiment may be improved. Therefore, the carmine-based pigment is present evenly on the surface of the toner of the present exemplary embodiment, whereby the adhesion between the yellow toner of the present exemplary embodiment and the magenta toner including the carmine-based pigment as a colorant is improved, and the superposed toner image becomes hard to be degraded. As a result, the reproducibility of a flesh color image is improved.

In the present exemplary embodiment, the "repeating unit derived from the bisphenol A ethylene oxide represented by the formula (1)" refer to a structural moiety of the polyester resin that is the bisphenol A ethylene oxide represented by the formula (1) before the polymerization reaction.

When m and n in the formula (1) are each 1, the hydrophilicity of the resin is increased, dispersing property in a highly hydrophobic colorant is decreased, adhesion to the magenta toner is decreased during image forming, whereby flesh color reproducibility may be sometimes decreased.

On the other hand, when m and n in the formula (1) are each 5 or more, the charging property of the toner is easily changed. Thus, control of the adhesion amount of the toner in the developing and transferring becomes difficult. As a result, flesh color reproducibility may be sometimes decreased.

In the formula (1), desirable ranges of m and n are each from 3 to 4.

In the present exemplary embodiment, a diol other than the bisphenol A ethylene oxide represented by the formula (1) may be used in combination for the synthesis of the polyester resin. Examples of the other diol may include aliphatic diols such as ethylene glycol, diethylene glycol, triethylene glycol, propylene glycol, butanediol, hexanediol, neopentyl glycol and glycerin; and cycloaliphatic diols such as cyclohexane diol, cyclohexane dimethanol and hydrogenised bisphenol A; aromatic diols such as a propylene oxide adduct of bisphenol A.

In the present exemplary embodiment, the ratio of the repeating units derived from the bisphenol A ethylene oxide represented by the formula (1) to the repeating units derived from all of the diols is preferably 10 mol % or more or about 10 mol % or more, more preferably 80 mol % or more or about 80 mol % or more, and specifically preferably 100 mol % or about 100 mol %.

Examples of the dicarboxylic acid used in the present exemplary embodiment may include aromatic carboxylic acids such as terephthalic acid, isophthalic acid, phthalic anhydride, trimellitic anhydride, pyromellitic acid and naphthalene dicarboxylate; aliphatic carboxylic acids such as maleic anhydride, fumaric acid, succinic acid, alkenylsuccinate anhydrides and adipic acid; and alicyclic carboxylic acids such as cyclohexane dicarboxylic acid, and these polyvalent carboxylic acids may be used by one kind or two or more kinds.

The polyester resin may be prepared under a polymerization temperature of from 180° C. to 230° C., and where necessary, the reaction is carried out while reducing the pressure in the reaction system to remove water and alcohols generated during condensation.

In the case when the polymerizable monomers such as the dicarboxylic acid and diol are not dissolved or compatible under the reaction temperature, they may be dissolved by adding a solvent having a high boiling point as a dissolution aid. In this case, the polycondensation reaction is performed while distilling off the dissolution aid. When a polymerizable monomer having poor compatibility is present during a copolymerization reaction, the polymerizable monomer having poor compatibility is preferably reacted with an acid or alcohol that is to be polycondensated with the polymerizable monomer in advance, and the product is polycondensated with the main components.

Examples of the catalyst that may be used for the preparation of the polyester resin include compounds of alkali metals such as sodium and lithium; compounds of alkali earth metals such as magnesium and calcium; compounds of metals such as zinc, manganese, antimony, titanium, tin, zirconium and germanium; phosphite compounds; phosphoric acid compounds; and amine compounds.

Specific examples include compounds such as sodium acetate, sodium carbonate, lithium acetate, lithium carbonate, calcium acetate, calcium stearate, magnesium acetate, zinc acetate, zinc stearate, zinc naphthenoate, zinc chloride, manganese acetate, manganese naphthenoate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyl tin, dibutyltin dichloride, dibutyltin oxide, diphenyltin oxide, zirconium tetrabutoxide, zirconium naphthenoate, zirconyl carbonate, zirconyl acetate, zirconyl stearate, zirconyl octylate, germanium oxide, triphenyl phosphite, tris(2,4-di-t-butylphenyl)phosphite, ethyltriphenylphosphonium bromide, triethylamine and triphenylamine.

The glass transition temperature (Tg) of the polyester resin used in the present exemplary embodiment is desirably in the range of from 35° C. or about 35° C. to 50° C. or about 50° C. When Tg is lower than 35° C., problems may be caused from the viewpoints of the storage property of the toner and the storage property of the fixed image. Furthermore, when Tg is higher than 50° C., fixing may not be performed at a lower temperature than conventional temperatures.

The Tg of the polyester resin is more desirably from 45° C. or about 45° C. to 50° C. or about 50° C.

The glass transition temperature of the polyester resin was obtained as a peak temperature of an endothermic peak that was obtained by differential scanning calorimetry (DSC).

The weight average molecular weight of the polyester resin used in present exemplary embodiment is desirably from 5,000 or about 5,000 to 30,000 or about 30,000, more desirably from 7,000 or about 7,000 to 20,000 or about 20,000.

The above weight average molecular weight is measured by gel permeation chromatography (GPC). The molecular weight measurement by GPC is performed by using a measurement apparatus (trade name: GPC HLC-8120, manufactured by Tosoh Corporation) and using a column (trade name: TSK GEL SUPER HM-M (15 cm), manufactured by Tosoh Corporation) in a THF solvent. The weight average molecular weight and number average molecular weight are measured using a molecular weight calibration curve that is prepared from the measurement results by using a monodispersed polystyrene standard sample.

In the present exemplary embodiment, where necessary, polyester resins other than the above specific polyester resin, ethylene-based resins such as polyethylene and polypropylene, styrene-based resins including polystyrene, poly(a-methylstyrene) or the like as a main component, (meth)acrylic-based resins including polymethyl(meth)acrylate, poly (meth)acrylonitrile or the like as a main component, polyamide resins, polycarbonate resins and polyether resins, and copolymer resins thereof may be used in combination as a binder resin.

The total amount of the binder resin included in the toner particles of the present exemplary embodiment is desirably from 40% by weight or about 40% by weight to 95% by weight or about 95% by weight, more desirably from 60% by weight or about 60% by weight to 85% by weight or about 85% by weight, with respect to the total weight of the solid contents in the toner particles.

—Release Agent—

In the present exemplary embodiment, the toner particles may include a release agent. Specific examples of the release agent include low molecular weight polyolefins such as polyethylene, polypropylene and polybutene; silicones having a softening point; aliphatic acid amides such as oleic acid amide, erucic acid amide, ricinoleic acid amide and stearic acid amide; vegetable waxes such as carnauba wax, rice wax, candellila wax, wood wax and jojoba oil; animal waxes such as beewax; mineral and petrolatum waxes such as Montan wax, ozokelite, ceresin, paraffin wax, microcrystalline wax and Fischer-Tropsch wax; waxes of esters of a higher aliphatic acid and a higher alcohol such as stearyl stearate and behenyl behenate; waxes of esters of a higher aliphatic acid and a monovalent or polyvalent lower alcohol such as butyl stearate, propyl oleate, monostearic acid glyceride, distearic acid glyceride and pentaerythritol tetrabehenate; waxes of esters formed of a higher aliphatic acid and a polyvalent alcohol multimer such as diethylene glycol monostearate, dipropylene glycol distearate, distearic acid diglyceride and tetrastearic acid triglyceride; sorbitan higher aliphatic acid ester waxes such as sorbitan monostearate; and cholesterol higher aliphatic acid ester waxes such as cholesteryl stearate.

These release agent may be used by singly one kind, or may be used as a combination of two or more kinds.

Of these, hydrocarbon-based waxes are preferable. By using the hydrocarbon-based wax as a release agent, the dispersing property of the carmine-based pigment included in the toner of the present exemplary embodiment is improved. Therefore, the carmine-based pigment is present evenly on the surface of the toner of the present exemplary embodiment, whereby the adhesion between the toner of the present exemplary embodiment and the magenta toner including the carmine-based pigment as a colorant is improved and the superposed toner image becomes hard to be degraded. As a result, the reproducibility of a flesh color image is further improved.

Among the hydrocarbon-based waxes, mineral and petrolatum waxes such as paraffin wax, microcrystalline wax and Fischer-Tropsch wax, and polyalkylene waxes that are modified products thereof are more preferable in that uniform elution on the surface of a fixed image during fixing and a suitable thickness of a release agent layer may be obtained, and the like. The hydrocarbon-based wax is more preferably a paraffin-based wax.

The addition amount of these release agents is preferably from 1% by weight to 20% by weight, more preferably from 5% by weight to 15% by weight with respect to the total weight of the solid contents in the toner particles.

—Other Components—

Besides the above binder resin and colorants, other components (particles) such as an internal additive, a charge controlling agent, organic particles, a lubricant and a polisher may be added to the toner particles according to the purpose.

Examples of the internal additive include a magnetic powder. The magnetic powder may be included in the case when the toner is used as a magnetic toner. As such magnetic powder, a material that is magnetized in a magnetic field is used, and examples thereof include metals such as ferrite, magnetite, reduced iron, cobalt, manganese and nickel, alloys, or compounds including these metals.

Although the charge controlling agent is not specifically limited, one being colorless or having a pale color may be preferably used. Examples include quaternary ammonium salt compounds, nigrosine-based compounds, dyes including a complex of aluminum, iron, chromium or the like, and triphenylmethane-based pigments.

Examples of the organic particles include all particles which are generally used as an external additive for toner surfaces such as vinyl-based resins, polyester resins and silicone resins. These organic particles may be used as a flow aid, a cleaning aid and the like.

Examples of the lubricant include aliphatic acid amides such as ethylenebisstearic acid amide and oleic acid amide, and aliphatic acid metal salts such as zinc stearate and calcium stearate.

Examples of the polisher include silica, alumina, and cerium oxide.

The content of the above other component may be of a degree in which the purpose of the present exemplary embodiment is not interrupted, and is generally a very small amount. Specifically, the content is preferably in the range of from 0.01% by weight to 5% by weight, more preferably in the range of from 0.5% by weight to 2% by weight with respect to the total weight of the solid contents in the toner particles.

—External Additive—

The toner of the present exemplary embodiment may include an external additive.

Examples of the above external additive include silica, alumina, titanium oxide, barium titanate, magnesium titanate, calcium titanate, strontium titanate, zinc oxide, quartz sand, clay, mica, wollastonite, diatomite, cerium chloride, red iron oxide, chromium oxide, cerium oxide, antimony trioxide, magnesium oxide, zirconium oxide, silicon carbide and silicon nitride. Of these, silica particles and/or titania particles are desirable, and hydrophobized silica particles and titania particles are specifically desirable.

As a method for surface modification such as hydrophobization, a conventionally-known process may be used. Specific examples include coupling treatments using silane, titanate, and aluminate, respectively. The coupling agents used for the coupling treatments are not specifically limited, and preferable examples include silane coupling agents such as methyltrimethoxysilane, phenyltrimethoxysilane, methylphenyldimethoxysilane, diphenyldimethoxysilane, vinyltrimethoxysilane, γ-aminopropyltrimethoxysilane, γ-chloropropyltrimethoxysilane, γ-bromopropyltrimethoxysilane, γ-glycidoxypropyltrimethoxysilane, γ-mercaptopropyltrimethoxysilane, γ-ureidopropyltrimethoxysilane, fluoroalkyltrimethoxysilanes and hexamethyldisilazane; titanate coupling agents; and aluminate coupling agents.

Furthermore, where necessary, various additive may be added externally, and examples of these additives include other flowing agents, cleaning aids such as polystyrene particles, polymethylmethacrylate particles and polyvinylidene fluoride particles, and polishers aiming at removing adhered substances on a photoreceptor such as zinc stearylamide and strontium titanate.

The addition amount of the above external additive is desirably in the range of from 0.1 parts by weight to 5 parts by weight, more desirably in the range of from 0.3 parts by weight to 2 parts by weight with respect to 100 parts by weight of the toner particles. When the addition amount is less than 0.1 parts by weight, the flowability of the toner may be deteriorated. Furthermore, it is not preferable since inconveniences such as deterioration of charging property and deterioration of electron charge exchanging property may be caused. On the other hand, when the addition amount is more than 5 parts by weight, excess coatings are formed, and the excess inorganic oxide transfers to a contacting element and may cause a secondary trouble.

(Property of Toner)

The shape factor SF1 of the toner of the present exemplary embodiment is desirably in the range from 140 or about 140 to 160 or about 160. By adjusting the shape factor SF1 of the toner to the above range, the fowl of the toner becomes irregular and the superposed toner image becomes hard to be degraded. Therefore, the reproducibility of a flesh color image is further improved.

The above shape factor SF1 is more desirably in the range of from 145 or about 145 to 155 or about 155.

The above shape factor SF1 is obtained by the following Formula (2).

$$SF1=(ML^2/A)\times(\pi/4)\times 100 \qquad \text{Formula (2)}$$

wherein ML is the absolute maximum length of the toner particles, and A is the projection surface area of the toner particles in the above formula (2).

SF1 is quantified by mainly analyzing a microscope image or a scanning electron microscope (SEM) image by using an image analyzer, and is calculated, for example, as follows. Namely, SF1 is obtained by importing an optical microscopic image of the particles scattered on the surface of a slide glass into a LUZEX analyzer via a video camera, obtaining the maxim length and projection surface area of 100 particles, performing calculation by the above formula (2), and obtaining the average value thereof.

The volume average particle diameter of the toner particle of the present exemplary embodiment is desirably in the range of from 8 μm or about 8 μm to 15 μm or about 15 μm, more desirably in the range of from 9 μm or about 9 μm to 14 μm or about 14 μm, further desirably in the range of from 10 μm or about 10 μm to 12 μm or about 12 μm. By adjusting the volume average particle diameter of the toner particle to the above range, the superposed toner image becomes hard to be degraded, whereby the reproducibility of a flesh color image is further improved.

The above volume average particle diameter is measured by using COULTER MULTICIZER (trade name, manufactured by Coulter) at an aperture diameter of 50 μm. In this case, the measurement is performed after dispersing the toner in an aqueous electrolyte solution (an aqueous solution of ISOTONE) for 30 or more seconds by ultrasonic wave.

The glass transition temperature (Tg) of the toner of the present exemplary embodiment is preferably from 35° C. or about 35° C. to 50° C. or about 50° C. When the glass transition temperature (Tg) of the toner is in the above range, the superposed toner image becomes hard to be degraded since the adhesion in the toner is further improved, whereby the reproducibility of a flesh color image is further improved.

The glass transition temperature (Tg) of the toner is preferably in the range of from 40° C. or about 40° C. to 50° C. or about 50° C.

The glass transition temperature (Tg) is a value that is obtained by using a differential scanning thermometer [trade name: DSC3110, thermal analysis system 001, manufactured by Mac Science], by the measurement according to JIS 7121-1987. For calibration of the temperature at the detection section of the apparatus, the melting temperature of a mixture of indium and zinc is used, and the melting heat of indium is used for correction of a calorie. A sample (toner) is put into an aluminum pan, the aluminum pan containing the sample and an empty aluminum pan as a control are set, and a measurement is performed at a temperature raising velocity of 10° C./min. The temperature at the intersection of a base line and a raising line on an endothermic part of a DSC curve obtained by the measurement is considered as a glass transition temperature.

<Process for Preparation of Toner>

The process for the preparation of the toner of the present exemplary embodiment is not specifically limited, and the toner particles are prepared by dry processes such as a kneading-pulverizing process, wet processes such as an emulsification-aggregation process and a suspension polymerization process, and the like, which are known, and an additive is added externally to the toner particles as needed. Of these processes, the kneading-pulverizing process is preferable.

The kneading-pulverizing process is a process in which a toner forming material including colorants and a binder resin is kneaded to give a kneaded product, and pulverizing the above kneaded product to prepare toner particles. When a toner is obtained by preparing toner particles by the kneading-pulverizing process, the convex portions on the surface of the toner are charged easier, whereby the adhesion of the toner to a latent image may be improved. Furthermore, when the toner particles are prepared by the kneading-pulverizing process, irregularity is increased and the contacting surface area between the toner particles is increased. Therefore, the adhesion of the yellow toner to the magenta toner also becomes even, whereby the reproducibility of a flesh color image is further improved.

More specifically, the kneading-pulverizing process is divided into kneading the toner forming material including the colorants and the binder resin and pulverizing the above kneaded product. Where necessary, the process may include other steps such as cooling the kneaded product formed by the kneading, and the like.

The respective steps are explained in detail.

—Kneading—

In the kneading, the toner forming material including the colorants and the binder resin is kneaded.

In the kneading, it is desirable to add a water-based medium (for example, waters such as distilled water and ion exchanged water, alcohols, and the like) by 0.5 part by weight to 5 parts by weight with respect to 100 parts by weight of the toner forming material.

Examples of a kneader used in the kneading include a monoaxial extruder, and a biaxial extruder. Hereinafter a kneader having a feed screw section and two kneading sections is explained as an example of the kneader with referring to a drawing, but the kneader is not limited to this.

FIG. 1 is a drawing which explains the state of a screw in an example of a screw extruder that is used in the kneading in the process for the preparation of the toner of the present exemplary embodiment.

Screw extruder 11 is constituted by barrel 12 equipped with a screw (not depicted), injection port 14 for injecting a toner forming material that is a raw material of the toner into the barrel 12, liquid addition port 16 for adding a water-based medium to the toner forming material in the barrel 12, and ejection port 18 for ejecting a kneaded product that is formed by kneading the toner forming material in the barrel 12, The barrel 12 is partitioned into, starting from the injection port 14, feed screw section SA for transporting the toner forming material injected from the injection port 14 to kneading section NA; the kneading section NA for melt-kneading the toner forming material by first kneading; feed screw section SB for transporting the toner forming material that is melt-kneaded in the kneading section NA to kneading section NB; the kneading section NB for melt-kneading the toner forming material by second kneading to form a kneaded product; and feed screw section SC for transporting the formed kneaded product to the ejection port 18.

Furthermore, different temperature controlling unit (not depicted) is installed with respect to each block in the inner portion of the barrel 12. Namely, the barrel 12 has a structure which may control block 12A to block 12J so as to have different temperatures. FIG. 1 shows a state in which the temperatures of the block 12A and block 12B are controlled to be t0° C., the temperatures of the block 12C to the block 12E are controlled to be t1° C., and the temperatures of the block 12F to the block 12J are controlled to be t2° C., respectively. Therefore, the toner forming material at the kneading section NA is heated to WC, and the toner forming material at the kneading section NB is heated to t2° C. Here, each of the reference numerals t0, t1 and t2 means a temperature in each of the blocks. The same reference numerals represent that the blocks thereof are controlled to the same temperature.

When the toner forming material including the binder resin, colorants, and a release agent and the like where necessary is fed to the barrel 12 from the injection port 14, the toner forming material is fed to the kneading section NA by the feed screw section SA. Since the temperature of the block 12C is set at t1° C. at this time, the toner forming material is heated and fed into the kneading section NA in a melt state. Furthermore, since the temperatures of the block 12D and the block 12E are also set at t1° C., the toner forming material is melt-kneaded under the temperature of t1° C. in the kneading section NA. The binder resin and the release agent are in a melt state at the kneading section NA, and are subjected to shear by a screw.

The toner forming material that has been kneaded in the kneading section NA is then fed to the kneading section NB by the feed screw section SB.

Then, a water-based medium is injected from the liquid addition port 16 to the barrel 12 in the feed screw section SB to add the water-based medium to the toner forming material. Although an embodiment in which the water-based medium is injected at the feed screw section SB is shown in FIG. 1, the invention is not limited to the embodiment, and the water-based medium may be injected at the kneading section NB, or the water-based medium may be injected at both of the feed screw section SB and the kneading section NB. Namely, the position from which the water-based medium is injected and the position to which the water-based medium is injected are selected as needed.

When the water-based medium is injected from the liquid addition port 16 to the barrel 12 as mentioned above, the toner forming material and the water-based medium in the barrel 12 are mixed, and the toner forming material is cooled by the evaporation latent heat of the water-based medium, whereby the temperature of the toner forming material is maintained suitably.

Finally, the kneaded product formed by melt-kneading by the kneading section NB is transported to the ejection port 18 by the feed screw section SC, and ejected from the ejection port 18.

The kneading using the screw extruder 11 as shown in FIG. 1 is performed as above.

—Cooling—

The cooling is a step in which the kneaded product formed in the above kneading is cooled. In the cooling, it is preferable to cool from the temperature of the kneaded product at the completion of the kneading to 40° C. or less at an average temperature decreasing velocity of 4° C./sec or more. When the cooling velocity of the kneaded product is slow, the mixture that is finely dispersed in the binder resin in the kneading (a mixture of the colorants and an internal additive such as a release agent that is added internally to the toner particles as needed) is recrystallized, whereby the dispersion diameter may be increased. On the other hand, it is preferable to rapidly cool the kneaded product at the above average temperature decreasing velocity since the state of dispersion at immediately after completion of the kneading is maintained as it is. The above average temperature decreasing velocity refers to the average value of the velocity of decrease in the temperature of the kneaded product from the completion of the kneading (for example, it is t2° C. when the screw extruder 11 of FIG. 1 is used) to 40° C.

The cooling process in the cooling may specifically be exemplified by, for example, by a process using a rolling roll, a tucking cooling belt or the like in which cooled water or brine is circulated. When cooling is performed by the above process, the cooling velocity is determined by the velocity of the rolling roll, the flow amount of the brine, the feeding amount of the kneaded product, the slab thickness of the kneaded product during rolling, and the like. The slab thickness is preferably a thickness from 1 to 3 mm.

—Pulverizing—

The kneaded product cooled by the cooling is pulverized in the pulverizing, whereby the toner particles are formed. In the pulverizing, for example, a mechanical pulverizer, a jet pulverizer or the like are used.

—Classifying—

The toner particles obtained in the pulverizing may be classified by the classifying as necessary so as to obtain toner particles having a volume average particle diameter in the objective range. In the classifying, a centrifuge classifier, an inertial classifier or the like that has been conventionally used is used, whereby a fine powder (toner particles that are smaller than a particle size of an objective range) and a coarse powder (toner particles that are larger than a particle size of an objective range) are removed.

—Externally Adding—

Inorganic particles such as the above specific silica, titania, and aluminum oxide may be added and adhered to the obtained toner particles for the purposes of adjusting charging, imparting flowability, imparting electron charge exchanging property and the like. These are performed by using, for example, a V-type blender, a Henschel mixer, a Lodige mixer or the like, and the adhesion is performed by several steps.

—Sieving—

Sieving may be included as necessary after the above externally adding. Specific examples of the sieving include a gyro shifter, an oscillation siever, and a wind force siever. By the sieving, the coarse powder of the external additive and the like are removed, and generation of stripes, dropping and the like may be suppressed.

<Developing Agent>

The developing agent of the present exemplary embodiment at least includes the toner of the present exemplary embodiment.

The toner of the present exemplary embodiment is directly used as a one-component developing agent, or as a two-component developing agent. If the toner is used as a two-component developing agent, it is used as a mixture with a carrier.

The carrier that may be used for the two-component developing agent is not specifically limited, and a known carrier may be used. Examples include magnetic metals such as iron oxide, nickel and cobalt, magnetic oxides such as ferrite and magnetite, resin-coated carriers including these materials as a core material and a resin coating layer formed on the surface of the core material, and a magnetic dispersion-type carrier. Alternatively, a resin dispersion-type carrier in which an electroconductive material and the like have been dispersed in a matrix resin may be used.

The mixing ratio (weight ratio) of the toner and the carrier in the above two-component developing agent is preferably in the range of toner:carrier=about 1:100 to 30:100, more preferably in the range of about 3:100 to 20:100.

<Image Forming Apparatus and Image Forming Process>

Next, the image forming apparatus of the present exemplary embodiment using the developing agent of the present exemplary embodiment is explained.

The image forming apparatus of the present exemplary embodiment includes a latent image holding member, a charging unit that charges the surface of the latent image holding member, an electrostatic latent image forming unit that forms an electrostatic latent image on the surface of the latent image holding member, a developing unit that develops the electrostatic latent image with the developing agent of the present exemplary embodiment to form a toner image, a transfer unit that transfers the toner image onto a recording medium, and a fixing unit that fixes the toner image on the recording medium.

In the image forming apparatus, for example, the part including the above developing unit may have a cartridge structure that is attachable to and detachable from the main body of the image forming apparatus (process cartridge). As the process cartridge, a process cartridge of the present exemplary embodiment including a developing unit, in which the developing agent of the present exemplary embodiment is housed, that forms a toner image by developing an electrostatic latent image formed on the surface of a latent image holding member with the developing agent, which is attachable to and detachable from an image forming apparatus, is preferably used.

Hereinafter an example of the image forming apparatus of the present exemplary embodiment is shown, but the present exemplary embodiment is not limited to the example. Only the main part as shown in the drawings is explained, and explanations on other parts are omitted.

Figure 2:
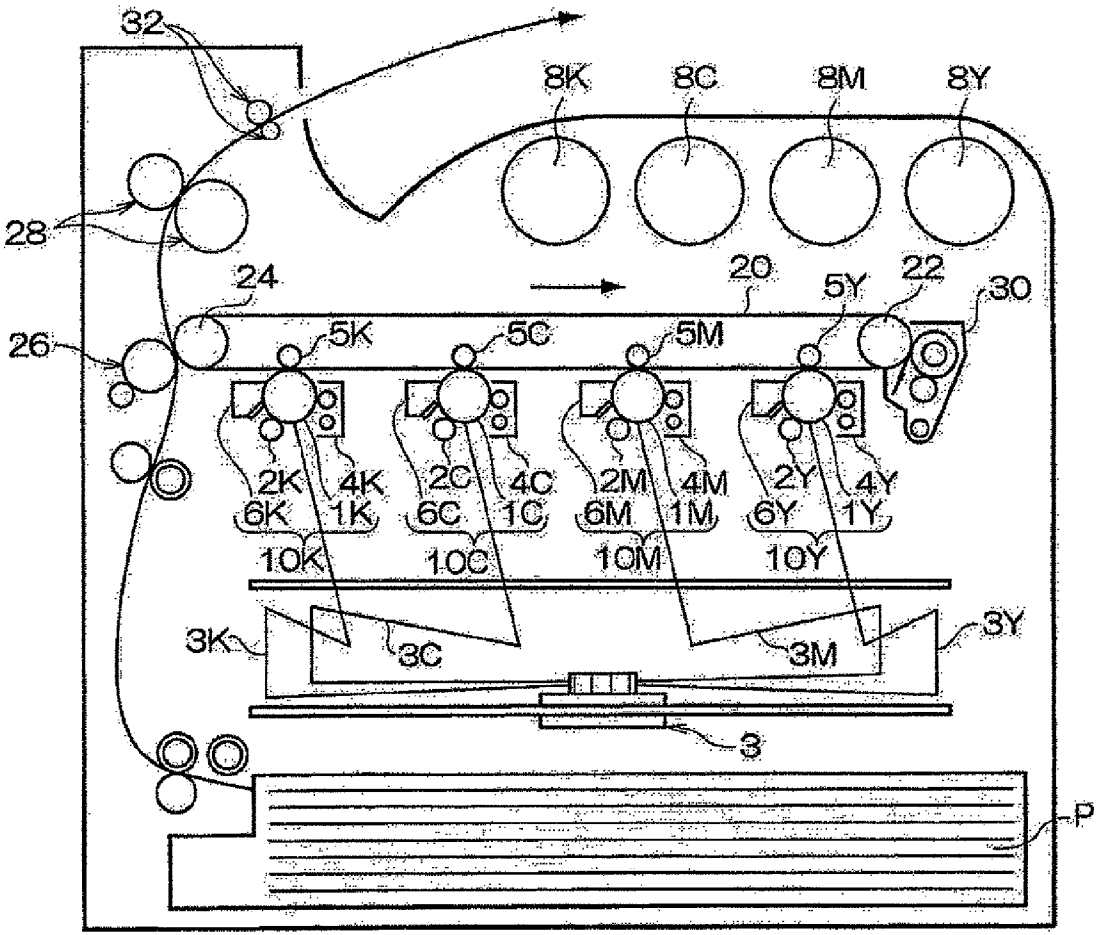
FIG. 2 is a schematic drawing that shows an example of the image forming apparatus of the present exemplary embodiment.

FIG. 2 is a schematic structural drawing that shows a 4-drum tandem system color image forming apparatus. The image forming apparatus shown in FIG. 2 includes first to fourth electrophotographic image forming units 10Y, 10M, 10C and 10K (image forming unit) that output images of respective colors of yellow (Y), magenta (M), cyan (C) and black (K) based on color-separated image data. These image forming units (hereinafter sometimes simply referred to as "units") 10Y, 10M, 10C and 10K are aligned in the horizontal direction at predetermined intervals. These units 10Y, 10M, 10C and 10K may be process cartridges that are attachable to and removable from the main body of the image forming apparatus.

Intermediate transfer belt 20 as an intermediate transfer body runs through above the respective units 10Y, 10M, 10C and 10K as shown in the drawing. The intermediate transfer belt 20 is wrapped around driving roller 22 and support roller 24 that are in contact with the inner surface of the intermediate transfer belt 20 so as to run in the direction from the first unit 10Y to the fourth unit 10K. The support roller 24 is biased toward the direction leaving from the driving roller 22 by a spring or the like that are not depicted, whereby a predetermined tension is applied to the intermediate transfer belt 20 that is wrapped around the rollers. Intermediate transfer body cleaning apparatus 30 is disposed on the side surface of the latent image holding member of the intermediate transfer belt 20 so as to oppose to the driving roller 22.

Toners of 4 colors of yellow, magenta, cyan and black that are housed in toner cartridges 8Y, 8M, 8C and 8K may be supplied to the respective developing apparatuses (developing unit) 4Y, 4M, 4C and 4K of the units 10Y, 10M, 10C and 10K.

Since the above first to fourth units 10Y, 10M, 10C and 10K have similar structures, the first unit 10Y for forming a yellow image that is disposed on the upstream of the running direction of the intermediate transfer belt is explained as a representative. The explanations on the second to fourth units 10M, 10C and 10K are omitted by adding the reference symbols of magenta (M), cyan (C) and black (K) instead of yellow (Y) to the similar parts to the first unit 10Y.

The first unit 10Y has photoreceptor 1Y that acts as a latent image holding member. Charging roller 2Y that charges the surface of the photoreceptor 1Y to a predetermined belectrical potential, exposing apparatus 3 that exposes the charged surface to laser beam 3Y based on color-separated image signal to form an electrostatic latent image, developing apparatus (developing unit) 4Y that supplies a charged toner to the electrostatic latent image to develop an electrostatic latent image, primary transfer roller (primary transfer unit) 5Y that transfers the developed toner image on the intermediate transfer belt 20, and photoreceptor cleaning apparatus (cleaning unit) 6Y that removes the toner remaining on the surface of the photoreceptor 1Y after the primary transfer are disposed in this order around the photoreceptor 1Y.

The primary transfer roller 5Y is disposed on the inner side of the intermediate transfer belt 20, and is disposed on the position opposing to the photoreceptor 1Y. Furthermore, bias power sources (not depicted) that apply primary transfer bias are connected respectively to the respective primary transfer rollers 5Y, 5M, 5C and 5K. Each bias power source varies the transfer bias that is applied to each primary transfer roller by the control by a controlling section that is not depicted.

Hereinafter the operation for forming a yellow image at the first unit 10Y is explained. First, prior to the operation, the surface of the photoreceptor 1Y is charged to have an electrical potential of about from −600 V to −800 V by the charging roller 2Y.

The photoreceptor 1Y is formed by laminating a photosensitive layer on an electroconductive (volume resistance rate at 20° C.: $1\times10^{-6}$ ncm or less) substrate. The photosensitive layer has property that it has generally a high resistance (resistance similar to that of a general resin) but when the laser beam 3Y is irradiated, the specific resistance of the part to which the laser beam has been irradiated is changed. Therefore, the laser beam 3Y is output via exposing apparatus 3 on the surface of the charged photoreceptor 1Y according to image data for yellow that is sent from a controlling section that is not depicted. The laser beam 3Y is irradiated on the photosensitive layer on the surface of the photoreceptor 1Y, whereby an electrostatic latent image having a yellow printing pattern is formed on the surface of the photoreceptor 1Y.

The electrostatic latent image is an image that is formed on the surface of the photoreceptor 1Y by charging, and is a so-called a negative latent image that is formed by that the specific resistance of the irradiated part of the photosensitive layer is decreased by the laser beam 3Y and the electron charge charged on the surface of the photoreceptor 1Y flows, whereas the electron charge on the part that has not been irradiated with the laser beam 3Y remains.

The electrostatic latent image formed on the photoreceptor 1Y as such is rotated to a predetermined developing position according to the running of the photoreceptor 1Y. Then, the electrostatic latent image on the photoreceptor 1Y is converted to a visible image (developed) by the developing apparatus 4Y on this developing position.

The yellow developing agent housed in the developing apparatus 4Y is friction-charged by being stirred in the developing apparatus 4Y, and retained on a developing agent roll (developing agent holding member) with an electron charge having similar polarity (negative polarity) to that of the charge that is charged on the photoreceptor 1Y. Furthermore, as the surface of the photoreceptor 1Y passes through the developing apparatus 4Y, the yellow toner electrostatically adheres on the erased latent image section on the surface of the photoreceptor 1Y, whereby a latent image is developed by the yellow toner. The photoreceptor 1Y on which the yellow toner image has been formed runs continuously at a predetermined velocity, and the toner image developed on the photoreceptor 1Y is carried to a predetermined primary transfer position.

When the yellow toner image on the photoreceptor 1Y is carried to the primary transfer position, a predetermined primary transfer bias is applied to the primary transfer roller 5Y, an electrostatic force that goes from the photoreceptor 1Y to the primary transfer roller 5Y acts on the toner image, and the toner image on the photoreceptor 1Y is transferred to the intermediate transfer belt 20. The transfer bias applied at this time has a polarity that is opposite (+) to the polarity of the toner (−), and is controlled to be, for example, about +10 μA by the controlling section (not depicted) in the first unit 10Y.

On the other hand, the toner remaining on the photoreceptor 1Y is removed by the cleaning apparatus 6Y and collected.

The primary transfer biases that are applied to the primary transfer rollers 5M, 5C and 5K in the second unit 10M and the following units are controlled in accordance with the first unit.

Thus, the intermediate transfer belt 20 on which the yellow toner image has been transferred at the first unit 10Y is carried through the second to fourth units 10M, 10C and 10K in this order, whereby toner images of respective colors are superposed to form a superposed toner image.

The intermediate transfer belt 20 on which the toner images of four colors have been superposed via the first to fourth units goes to the secondary transfer section that is constituted by the intermediate transfer belt 20, the support roller 24 that is in contact with the inner surface of the intermediate transfer belt 20, and secondary transfer roller (secondary transfer unit) 26 that is disposed on the side of the image holding surface of the intermediate transfer belt 20. On the other hand, recording paper (an object to which an image is transferred) P is fed via a feeding mechanism at a predetermined timing to a gap at which the secondary transfer roller 26 and the intermediate transfer belt 20 are brought into contact with pressure, and a predetermined secondary transfer bias is applied to the support roller 24. The transfer bias applied at this time has a polarity that is the same (−) as the polarity of the toner (−), and an electrostatic force that goes from the intermediate transfer belt 20 toward the recording paper P acts on the superposed toner image, whereby the superposed toner image on the intermediate transfer belt 20 is transferred onto the recording paper P. The secondary transfer bias at this time is determined according to the resistance that is detected by a resistance detecting unit (not depicted) for detecting the resistance at the secondary transfer section, and is controlled by voltage.

The recording paper P is then fed to fixing apparatus (fixing unit) 28 and the superposed toner image is heated, whereby the color-superposed toner image is melted and fixed on the recording paper P. The recording paper P on which fixing of a color image has been completed is carried by carrying roll (ejection roll) 32 toward an ejection section, whereby a series of operations for forming a color image is completed.

Although the image forming apparatus exemplified above has a structure in which the superposed toner image is transferred onto the recording paper P via the intermediate transfer belt 20, the structure is not limited to this structure, and a structure in which a toner image is directly transferred from a photoreceptor onto recording paper may also be available.

According to the color image forming apparatus as shown in FIG. 2, a process for forming an image, including developing an electrostatic latent image with plural kinds of toners to form plural toner images with the plural kinds of toners, transferring the plural toner images to the surface of a recording medium to form a superposed toner image including plural layers, and fixing the superposed toner image to form an image is carried out. In this case, the image forming process of the present exemplary embodiment may be carried out by using the toner of the present exemplary embodiment as the yellow toner and a magenta toner including a carmine-based pigment as a colorant as the magenta toner.

<Process Cartridge and Toner Cartridge>

Figure 3:
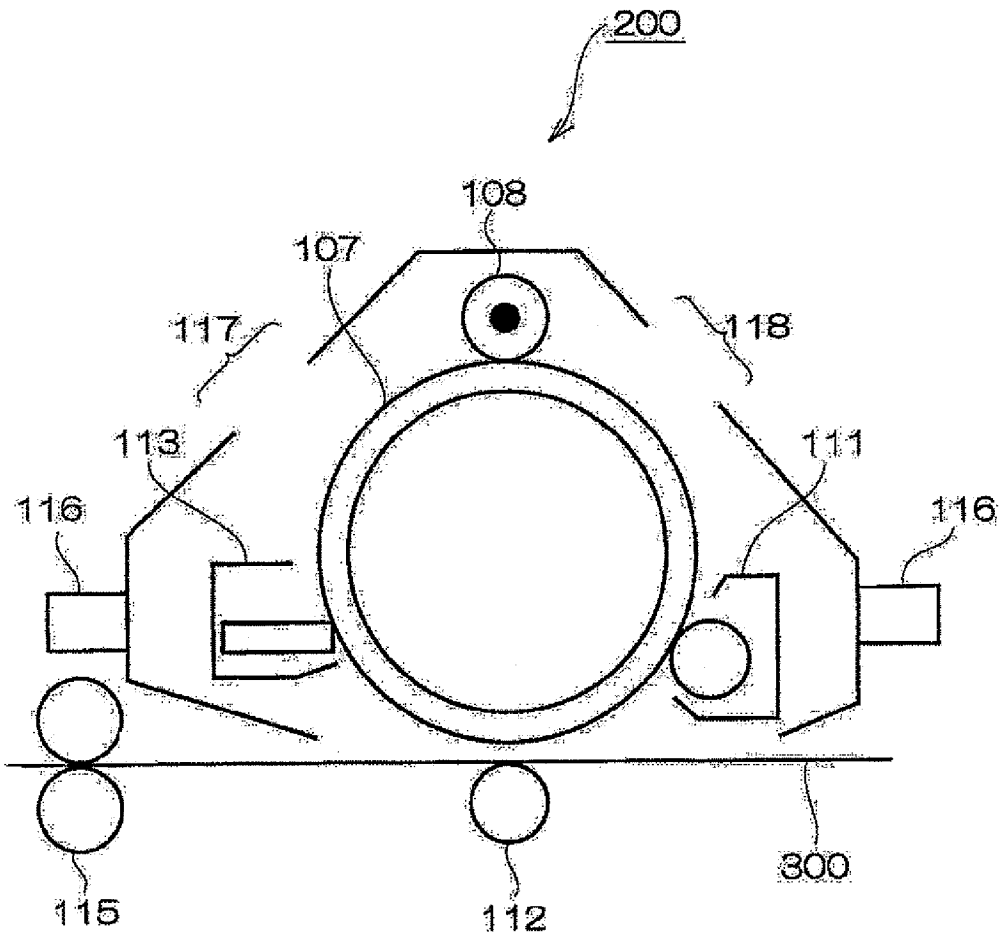
FIG. 3 is a schematic drawing that shows an example of the process cartridge of the present exemplary embodiment.

FIG. 3 is a schematic structural drawing that shows a preferable example of a process cartridge that houses the developing agent set of the invention. Process cartridge 200 is obtained by combining and integrating photoreceptor 107, charging roller 108, developing apparatus 111, photoreceptor cleaning apparatus (cleaning unit) 113, opening for exposure 118 and opening for erasing exposure 117 by using attachment rail 116.

The process cartridge 200 is attachable to and detachable from the main body of the image forming apparatus that is constituted by the transfer apparatus 112, the fixing apparatus 115, and other structural parts that are not depicted, and constitutes the image forming apparatus together with the main body of the image forming apparatus. Recording paper is represented by 300.

Although the process cartridge 200 shown in FIG. 3 includes the photoreceptor 107, charging apparatus 108, developing apparatus 111, cleaning apparatus 113, opening for exposure 118, and opening for erasing exposure 117, these apparatuses may be selectively combined. The process cartridge of the present exemplary embodiment may include, besides the developing apparatus 111, at least one kind selected from the group consisting of the photoreceptor 107, charging apparatus 108, cleaning apparatus (cleaning unit) 113, opening for exposure 118 and opening for erasing exposure 117.

Next, the toner cartridge is explained.

The toner cartridge is a toner cartridge that houses at least a toner to be supplied to the developing unit that is disposed on the above image forming apparatus, and the toner cartridge being mounted attachably and detachably on the image forming apparatus, wherein the toner is the toner of the present exemplary embodiment as mentioned above. The toner cartridge may house at least the toner, and for example, a developing agent may be housed depending on the mechanism of the image forming apparatus.

The image forming apparatus shown in FIG. 2 is an image forming apparatus that has a structure that enables attaching and detaching of the toner cartridges 8Y, 8M, 8C and 8K, and the developing apparatuses 4Y, 4M, 4C and 4K are connected to toner cartridges that correspond to respective developing apparatuses (colors) via developing agent supply tubes that are not depicted. Furthermore, when the developing agent housed in the toner cartridge is decreased, the toner cartridge may be replaced.

EXAMPLES

Hereinafter the present exemplary embodiment is explained more specifically in detail with referring to Examples and Comparative Examples. However, the present exemplary embodiment is not limited by the following Examples. Unless otherwise mentioned, the "part" and "%" are based on weight.

(Synthesis of Binder Resin 1-1)

Oxymethane (1.1)-2,2-bis(4-hydroxyphenyl)propane 40 parts

Ethylene glycol 10 parts

Terephthalic acid 45 parts

Fumaric acid 5 parts

The above are put into a round bottom flask equipped with a stirring apparatus, a nitrogen introduction tube, a temperature sensor and a rectification column, and the temperature is raised to 200° C. using a mantle heater. Nitrogen gas is then introduced from a gas introduction tube, and the mixture is stirred while the inside of the flask is maintained at an inactive gas atmosphere. Thereafter 0.05 part of dibutyltin oxide is added to 100 parts of the raw material mixture, and the mixture is reacted for a predetermined period while maintaining the temperature of the reactant to 200° C. to give binder resin 1-1.

The Tg of the obtained resin Tg is 44° C. according to a DSC measurement.

(Synthesis of Binder Resin 1-2)

Binder resin 1-2 is obtained by using similar composition and synthesis process to those for the binder resin 1-1, except that oxymethane (1.1)-2,2-bis(4-hydroxyphenyl)propane is replaced with polyoxyethylene(1.2)-2,2-bis(4-hydroxyphenyl)propane. The Tg of the obtained resin is 44° C. according to a DSC measurement.

(Synthesis of Binder Resin 1-3)

Binder resin 1-3 is obtained by using similar composition and synthesis process to those for the binder resin 1-1, except that oxymethane (1.1)-2,2-bis(4-hydroxyphenyl)propane is replaced with polyoxypropylene (1.3)-2,2-bis(4-hydroxyphenyl)propane. The Tg of the obtained resin is 44° C. according to a DSC measurement.

(Synthesis of Binder Resin 1-4)

Binder resin 1-4 is obtained by using similar composition and synthesis process to those for the binder resin 1-1, except that oxymethane (1.1)-2,2-bis(4-hydroxyphenyl)propane is replaced with polyoxybutylene (1.4)-2,2-bis(4-hydroxyphenyl)propane. The Tg of the obtained resin is 44° C. according to a DSC measurement.

(Synthesis of Binder Resin 1-5)

Binder resin 1-5 is obtained by using similar composition and synthesis process to those for the binder resin 1-1, except that oxymethane (1.1)-2,2-bis(4-hydroxyphenyl)propane is replaced with polyoxypentene (1.5)-2,2-bis(4-hydroxyphenyl)propane. The Tg of the obtained resin is 44° C. according to a DSC measurement.

(Synthesis of Binder Resin 2)

Binder resin 2 is obtained by using similar composition and synthesis process to those for the binder resin 1-3, except that terephthalic acid is changed to 35 parts and fumaric acid is changed to 15 parts. The Tg of the obtained resin is 34° C. according to a DSC measurement.

(Synthesis of Binder Resin 3)

Binder resin 3 is obtained by using similar composition and synthesis process to those for the binder resin 1-3, except that terephthalic acid is changed to 36 parts and fumaric acid is changed to 14 parts. The Tg of the obtained resin is 35° C. according to a DSC measurement.

(Synthesis of Binder Resin 4)

Binder resin 4 is obtained by using similar composition and synthesis process to those for the binder resin 1-3, except that terephthalic acid is changed to 37 parts and fumaric acid is changed to 13 parts. The Tg of the obtained resin is 36° C. according to a DSC measurement.

(Synthesis of Binder Resin 5)

Binder resin 5 is obtained by using similar composition and synthesis process to those for the binder resin 1-3, except that terephthalic acid is changed to 41 parts and fumaric acid is changed to 9 parts. The Tg of the obtained resin is 40° C. according to a DSC measurement.

(Synthesis of Binder Resin 6)

Binder resin 6 is obtained by using similar composition and synthesis process to those for the binder resin 1-3, except that terephthalic acid is changed to 49 parts and fumaric acid is changed to 1 part. The Tg of the obtained resin is 48° C. according to a DSC measurement.

(Synthesis of Binder Resin 7)

Binder resin 7 is obtained by using similar composition and synthesis process to those for the binder resin 1-3 except that polyoxypropylene (1.3)-2,2-bis(4-hydroxyphenyl)propane is changed to 41 parts and ethylene glycol is changed to 9 parts. The Tg of the obtained resin is 51° C. according to a DSC measurement.

(Preparation of Toner 1)

Binder resin 1-3: 1760 parts

Release agent (polypropylene; trade name: MITSUI HI-WAX NP055, manufactured by Mitsui Chemicals, Inc.): 100 parts C. I. Pigment yellow 180 (trade name: NOVOPERM YELLOW P-H9, manufactured by Clariant): 99.55 parts Carmine-based pigment (trade name: SEIKAFAST, C. I. Pigment Red 57:1, manufactured by Dainichiseika Color & Chemicals Mfg Co., Ltd.) 0.05 part 40 nm silica (trade name: OX-50, manufactured by Nippon Aerosil Co., Ltd.): 20 parts Rosin (trade name: HARTALL RX, manufactured by Harima chemicals Inc.): 20 parts The above components are subjected to raw material blending by a 75 L Henshel mixer, and kneading is carried out under the following condition by using a continuous kneader (biaxial extruder) having the screw structure of FIG. 1. The rotation number of the screw is 500 rpm.

Feed sections (blocks 12A and 12B) set temperature 20° C.

Kneading section 1 kneading set temperature (from block 12C to 12E) 120° C.

Kneading section 2 kneading set temperature (from block 12F to 12J) 135° C.

Addition amount of water-based medium (distilled water): 1.5 parts with respect to 100 parts of the feeding amount of the raw material The kneaded product temperature at the ejection port (ejection port 18) at this time is 125° C.

The kneaded product is rapidly cooled by using a rolling roll through which brine of −5° C. has been passed and a slab tucking cooling belt that has been cooled by cooled water of 2° C., and crushed with a hammer mill after cooling. The velocity of rapid cooling is confirmed while changing the velocity of the cooling belt, and the average temperature decreasing velocity is 10° C./see.

Thereafter, pulverizing is carried out by using a pulverizer (AFG400) in which a coarse powder classifier is installed to give pulverized particles. Thereafter the particles are classified by an inertial classifier, and fine powder and coarse powder are removed to give toner particles 1.

The shape factor SF1 of the obtained toner particles 1 is 150.

1.0 part of 30 nm silica (MOX treated with isobutyltrimethoxysilane, manufactured by Nippon Aerosil Co., Ltd.) and 0.5 part of 16 nm silica (trade name: R972, manufactured by Nippon Aerosil Co., Ltd.) are added to 100 parts of the obtained toner particles 1 and mixed by a Henschel mixer for 3 minutes (tip velocity of rotary wing: 22 m/s) to give toner 1.

The toner 1 is dissolved in toluene, insoluble components are extracted, and that the ratio of the amount of PY180/the amount of carmine is 1991 is confirmed from IR and fluorescent X-ray analyses and NMR analysis.

(Preparation of Toner 2)

Toner 2 is obtained in a similar manner to the preparation of the toner 1, except that the binder resin 1-4 is used instead of the binder resin 1-3.

(Preparation of Toner 3)

Toner 3 is obtained in a similar manner to the preparation of the toner 1, except that the binder resin 1-2 is used instead of the binder resin 1-3.

(Preparation of Toner 4)

Toner 4 is obtained in a similar manner to the preparation of the toner 1, except that the content of the carmine-based pigment is changed to 0.01 part.

(Preparation of Toner 5)

Toner 5 is obtained in a similar manner to the preparation of the toner 1, except that the content of C. I. Pigment yellow 180 is changed to 102 parts and the content of the carmine-based pigment is changed to 1 part.

(Preparation of Toner 6)

Toner 6 is obtained in a similar manner to the preparation of the toner 1, except that the content of C. I. Pigment yellow 180 is changed to 99.7 parts and the content of the carmine-based pigment is 0.04 part.

(Preparation of Toner 7)

Toner 7 is obtained in a similar manner to the preparation of the toner 1, except that the content of C. I. Pigment yellow 180 is changed to 102 parts and the content of the carmine-based pigment is changed to 0.04 part.

(Preparation of Toner 8)

Toner 8 is obtained in a similar manner to the preparation of the toner 1, except that the content of the carmine-based pigment is changed to 0.095 part.

(Preparation of Toner 9)

Toner 9 is obtained in a similar manner to the preparation of the toner 1, except that the content of C, I. Pigment yellow 180 is changed to 106 parts and the content of the carmine-based pigment is changed to 0.11 part.

(Preparation of Toner 10 to toner 17)

Toner 10 to toner 17 are obtained in a similar manner to the preparation of the toner 1, except that the pulverization condition of the pulverizer and the classification condition of the inertia classifier are adjusted.

(Preparation of Toner 18)

Toner 18 is obtained in a similar manner to the preparation of the toner 1, except that polyethylene (trade name: SANWAX 151 P, manufactured by Sanyo Chemical Industries, Ltd.) is used as a release agent instead of polypropylene.

(Preparation of Toner 19)

Toner 19 is obtained in a similar manner to the preparation of the toner 1, except that a Fischer-Tropsch wax (trade name: FNP0092, manufactured by Nippon Seiro Co., Ltd.) is used as a release agent instead of polypropylene.

(Preparation of Toner 20)

Toner 20 is obtained in a similar manner to the preparation of the toner 1, except that polyester (trade name: WEP5, manufactured by NOF Corporation) is used as a release agent instead of polypropylene.

(Preparation of Toner 21)

Toner 21 is obtained in a similar manner to the preparation of the toner 1, except that carnauba wax (trade name: CARNAUBA WAX 1, manufactured by S. Kato & Co.) is used as a release agent instead of polypropylene.

(Preparation of Toner 22)

Toner 22 is obtained in a similar manner to the preparation of the toner 1, except that the binder resin 2 is used instead of the binder resin 1-3.

(Preparation of Toner 23)

Toner 23 is obtained in a similar manner to the preparation of the toner 1, except that the binder resin 3 is used instead of the binder resin 1-3.

(Preparation of Toner 24)

Toner 24 is obtained in a similar manner to the preparation of the toner 1, except that the binder resin 4 is used instead of the binder resin 1-3.

(Preparation of Toner 25)

Toner 25 is obtained in a similar manner to the preparation of the toner 1, except that the binder resin 5 is used instead of the binder resin 1-3.

(Preparation of Toner 26)

Toner 26 is obtained in a similar manner to the preparation of the toner 1, except that the binder resin 6 is used instead of the binder resin 1-3.

(Preparation of Toner 27)

Toner 27 is obtained in a similar manner to the preparation of the toner 1, except that the binder resin 7 is used instead of the binder resin 1-3.

(Preparation of Toner 28)

Toner 28 is obtained in a similar manner to the preparation of the toner 1, except that Naphthol Carmine FB (trade name: SEIKAFAST R5, manufactured by Dainichiseika Color & Chemicals Mfg Co., Ltd.) is used instead of the carmine-based pigment (trade name: SEIKAFAST, C. I. Pigment Red 57:1, manufactured by Dainichiseika Color & Chemicals Mfg Co., Ltd.).

(Preparation of Toner 29)

Toner 29 is obtained in a similar manner to the preparation of the toner 1, except that the binder resin 1-5 is used instead of the binder resin 1-3.

(Preparation of Toner 30)

Toner 30 is obtained in a similar manner to the preparation of the toner 1, except that the binder resin 1-1 is used instead of the binder resin 1-3.

(Preparation of Toner 31)

Toner 31 is obtained in a similar manner to the preparation of the toner 1, except that the content of C. I. Pigment yellow 180 is changed to 98.5 parts and the content of the carmine-based pigment is changed to 1.15 parts.

(Preparation of Toner 32)

Toner 32 is obtained in a similar manner to the preparation of the toner 1, except that the content of C. I. Pigment yellow 180 is changed to 99.1 parts and the content of the carmine-based pigment is changed to 0.009 parts.

(Preparation of Toner 33)

Toner 33 is obtained in a similar manner to the preparation of the toner 1, except that chromofine red dimethylquinacridone (trade name: PR122, manufactured by Dainichiseika Color & Chemicals Mfg Co., Ltd.) is used instead of the carmine-based pigment.

(Preparation of Toner 34)

Toner 34 is obtained in a similar manner to the preparation of the toner 1, except that C. I. Pigment yellow 185 (trade name: HANSA YELLOW 5GX01, manufactured by Clariant) is used instead of C. I. Pigment yellow 180.

(Preparation of Toner 35)

Toner 35 is obtained in a similar manner to the preparation of the toner 1, except that C. I. Pigment yellow 185 (trade name: HANSA YELLOW 5GX01, manufactured by Clariant) is used instead of C. I. Pigment yellow 180 and chromofine red dimethylquinacridone (trade name: PR122, manufactured by Dainichiseika Color & Chemicals Mfg Co., Ltd.) is used instead of the carmine-based pigment.

(Preparation of Magenta Toner)

A magenta toner is obtained in a similar manner to the preparation of the toner 1, except that 100 parts of a carmine-based pigment (trade name: SEIKAFAST, C. I. Pigment Red 57:1, manufactured by Dainichiseika Color & Chemicals Mfg Co., Ltd.) is used as a colorant instead of using 99.5 parts of C. I. Pigment yellow 180 and 0.05 part of the carmine-based pigment.

<Preparation of Carrier>

1,000 parts of Mn—Mg ferrite [average particle size 50 μm: manufactured by Powdertech] is put into a kneader, and a solution in which 150 parts of a styrene-methyl methacrylate-acrylic acid copolymer [polymerization ratio 39:60:1 (molar ratio), Tg 100° C., weight average molecular weight 73,000: manufactured by Soken Chemical & Engineering Co., Ltd.] has been dissolved in 700 parts of toluene is added. The mixture is mixed under ordinary temperature for 20 minutes, heated to 70° C., dried under a reduced pressure and removed to give a coated carrier. The obtained coated carrier is sieved by a mesh having openings of 75 μm to remove crude powder to give carrier 1.

<Preparation of Developing Agent>

The carrier 1 and the toners 1 to 35 or the magenta toner are put into a V blender by a weight ratio of 95:5, respectively, and the mixture is stirred for 20 minutes to give yellow developing agents 1 to 35 and a magenta developing agent.

<Evaluation>

The yellow developing agents 1 to 35, and the magenta developing agent are respectively filled in APEOSPORT-C4300 (trade name, manufactured by Fuji Xerox Co., Ltd.). A flesh color image is output on coated paper (127.9 g/m$^3$) in accordance with JAPAN COLOR 2007 (JCS2007) for sheet-fed printing. The obtained flesh color image is evaluated visually based on the following criteria.

—Evaluation Criteria for Flesh Color Reproducibility—

A: No difference in flesh color is felt as compared to JAPAN COLOR 2007 (JCS2007) for sheet-fed printing.

B: Flesh color is slightly reddish as compared to JAPAN COLOR 2007 (JCS2007) for sheet-fed printing, but there is no strangeness.

C: Flesh color is reddish to a certain degree as compared to JAPAN COLOR 2007 (JCS2007) for sheet-fed printing, but there is no strangeness.

D: Redness of flesh color is obviously felt strongly as compared to JAPAN COLOR 2007 (JCS2007) for sheet-fed printing.

The results obtained are shown in Tables 1 and 2, together with the values of m and n in the repeating unit derived from the bisphenol A ethylene oxide represented by the formula (1) included in the binder resin (in Tables 1 and 2, when the values of m and n are the same, only one value is presented), the content of the C. I. Pigment yellow 180, the content of the carmine-based pigment, the weight ratio of the C. I. Pigment yellow 180 to the carmine-based pigment (the amount of PY180/the amount of the carmine), the volume average particle diameter of the toner particle, the SF1 of the toner, the kind of the release agent, the kind of the binder resin, and the glass transition temperature of the toner.

TABLE 1

| | Toner | Values of m and n in formula (1) | Amount of PY180 Parts | Amount of carmine-based pigment Parts | Amount of PY180/ Amount of carmine | Volume average particle diameter μm | SF1 | Release agent | Binder resin | Glass transition temperature | Reproducibility of flesh color |
|---|---|---|---|---|---|---|---|---|---|---|---|
| Example 1 | 1 | 3 | 99.55 | 0.05 | 1991 | 10 | 150 | Polypropylene | 1-3 | 44° C. | A |
| Example 2 | 2 | 4 | 99.55 | 0.05 | 1991 | 10 | 150 | Polypropylene | 1-4 | 44° C. | A |
| Example 3 | 3 | 2 | 99.55 | 0.05 | 1991 | 10 | 150 | Polypropylene | 1-2 | 44° C. | A |
| Example 4 | 4 | 3 | 99.55 | 0.01 | 9955 | 10 | 150 | Polypropylene | 1-3 | 44° C. | C |
| Example 5 | 5 | 3 | 102 | 1 | 102 | 10 | 150 | Polypropylene | 1-3 | 44° C. | C |
| Example 6 | 6 | 3 | 99.7 | 0.04 | 2493 | 10 | 150 | Polypropylene | 1-3 | 44° C. | A |
| Example 7 | 7 | 3 | 102 | 0.04 | 2550 | 10 | 150 | Polypropylene | 1-3 | 44° C. | B |
| Example 8 | 8 | 3 | 99.55 | 0.095 | 1048 | 10 | 150 | Polypropylene | 1-3 | 44° C. | A |
| Example 9 | 9 | 3 | 106 | 0.11 | 964 | 10 | 150 | Polypropylene | 1-3 | 44° C. | B |
| Example 10 | 10 | 3 | 99.55 | 0.05 | 1991 | 7 | 150 | Polypropylene | 1-3 | 44° C. | B |
| Example 11 | 11 | 3 | 99.55 | 0.05 | 1991 | 8 | 150 | Polypropylene | 1-3 | 44° C. | A |
| Example 12 | 12 | 3 | 99.55 | 0.05 | 1991 | 14.5 | 150 | Polypropylene | 1-3 | 44° C. | A |
| Example 13 | 13 | 3 | 99.55 | 0.05 | 1991 | 16 | 150 | Polypropylene | 1-3 | 44° C. | B |
| Example 14 | 14 | 3 | 99.55 | 0.05 | 1991 | 10 | 162 | Polypropylene | 1-3 | 44° C. | B |
| Example 15 | 15 | 3 | 99.55 | 0.05 | 1991 | 10 | 159 | Polypropylene | 1-3 | 44° C. | A |
| Example 16 | 16 | 3 | 99.55 | 0.05 | 1991 | 10 | 141 | Polypropylene | 1-3 | 44° C. | A |
| Example 17 | 17 | 3 | 99.55 | 0.05 | 1991 | 10 | 139 | Polypropylene | 1-3 | 44° C. | B |
| Example 18 | 18 | 3 | 99.55 | 0.05 | 1991 | 10 | 150 | Polyethylene | 1-3 | 44° C. | A |

TABLE 2

| | Toner | Values of m and n in formula (1) | Amount of PY180 Parts | Amount of carmine-based pigment Parts | Amount of PY180/ Amount of carmine | Volume average particle diameter μm | SF1 | Release agent | Binder resin | Glass transition temperature | Reproducibility of flesh color |
|---|---|---|---|---|---|---|---|---|---|---|---|
| Example 19 | 19 | 3 | 99.55 | 0.05 | 1991 | 10 | 150 | Fischer-Tropsch | 1-3 | 44° C. | A |
| Example 20 | 20 | 3 | 99.55 | 0.05 | 1991 | 10 | 150 | Ester | 1-3 | 44° C. | B |
| Example 21 | 21 | 3 | 99.55 | 0.05 | 1991 | 10 | 150 | Carnauba | 1-3 | 44° C. | B |
| Example 22 | 22 | 3 | 99.55 | 0.05 | 1991 | 10 | 150 | Polypropylene | 2 | 34° C. | B |
| Example 23 | 23 | 3 | 99.55 | 0.05 | 1991 | 10 | 150 | Polypropylene | 3 | 35° C. | A |
| Example 24 | 24 | 3 | 99.55 | 0.05 | 1991 | 10 | 150 | Polypropylene | 4 | 36° C. | A |
| Example 25 | 25 | 3 | 99.55 | 0.05 | 1991 | 10 | 150 | Polypropylene | 5 | 40° C. | A |
| Example 26 | 26 | 3 | 99.55 | 0.05 | 1991 | 10 | 150 | Polypropylene | 6 | 48° C. | A |
| Example 27 | 27 | 3 | 99.55 | 0.05 | 1991 | 10 | 150 | Polypropylene | 7 | 51° C. | B |
| Example 28 | 28 | 3 | 99.55 | SEIKAFAST R5 0.05 | 1991 | 10 | 150 | Polypropylene | 1-3 | 44° C. | A |
| Comparative Example 1 | 29 | 5 | 99.55 | 0.05 | 1991 | 10 | 150 | Polypropylene | 1-5 | 44° C. | D |
| Comparative Example 2 | 30 | 1 | 99.55 | 0.05 | 1991 | 10 | 150 | Polypropylene | 1-1 | 44° C. | D |
| Comparative Example 3 | 31 | 3 | 98.5 | 1.15 | 86 | 10 | 150 | Polypropylene | 1-3 | 44° C. | D |

TABLE 2-continued

| | Toner | Values of m and n in formula (1) | Amount of PY180 Parts | Amount of carmine-based pigment Parts | Amount of PY180/ Amount of carmine | Volume average particle diameter μm | SF1 | Release agent | Binder resin | Glass transition temperature | Reproducibility of flesh color |
|---|---|---|---|---|---|---|---|---|---|---|---|
| Comparative Example 4 | 32 | 3 | 99.1 | 0.009 | 11011 | 10 | 150 | Polypropylene | 1-3 | 44° C. | D |
| Comparative Example 5 | 33 | 3 | 99.55 | PR122 0.05 | 1991 | 10 | 150 | Polypropylene | 1-3 | 44° C. | D |
| Comparative Example 6 | 34 | 3 | PY185 99.55 | 0.05 | 1991 | 10 | 150 | Polypropylene | 1-3 | 44° C. | D |
| Comparative Example 7 | 35 | 3 | PY185 99.55 | PR122 0.05 | 1991 | 10 | 150 | Polypropylene | 1-3 | 44° C. | D |

What is claimed is:

1. A yellow toner comprising toner particles comprising colorants and a binder resin, the colorants comprising at least a C. I. Pigment yellow 180 and a carmine-based pigment, a weight ratio of the C. I. Pigment yellow 180 to the carmine-based pigment being from about 99:1 to about 2,500:1, the binder resin being a polyester resin comprising a first repeating unit derived from a first diol compound, and the first diol compound being a bisphenol A ethylene oxide represented by the following formula (1):

Formula (1)

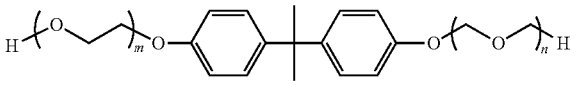

wherein in formula (1), m and n each independently represent an integer of from 2 to 4.

2. The yellow toner of claim 1, wherein a volume average particle diameter of the yellow toner is from about 8 μm to about 15 μm.

3. The yellow toner of claim 1, wherein a shape factor SF1 of the yellow toner is from about 140 to about 160.

4. The yellow toner of claim 1, wherein the toner particles further comprise a hydrocarbon-based wax as a release agent.

5. The yellow toner of claim 4, wherein the hydrocarbon-based wax is a paraffin-based wax.

6. The yellow toner of claim 1, wherein a glass transition temperature of the yellow toner is from about 35° C. to about 50° C.

7. The yellow toner of claim 1, wherein a total amount of the colorants included in the toner particles is from about 1 part by weight to about 20 parts by weight with respect to 100 parts by weight of the binder resin.

8. The yellow toner of claim 1, wherein the polyester resin further comprises a second repeating unit derived from a second diol compound, and a ratio of the first repeating unit derived from the first diol compound to a total of repeating units derived from diol, including the first repeating unit and the second repeating unit, is about 80 mol % or more.

9. The yellow toner of claim 1, wherein a glass transition temperature of the polyester resin is from about 45 0° C. to about 50° C.

10. The yellow toner of claim 1, wherein a weight average molecular weight of the polyester resin is from about 5,000 to about 30,000.

11. The yellow toner of claim 1, wherein a total amount of the binder resin included in the toner particles is from about 40% by weight to about 95% by weight with respect to a total weight of solid contents in the toner particles.

12. The yellow toner of claim 1, wherein the carmine-based pigment is a C. I. Pigment Red 57:1.

13. The yellow toner of claim 1, wherein the toner particles are obtained by kneading a toner forming material comprising the colorants and the binder resin to give a kneaded product, and pulverizing the kneaded product.

14. A developing agent comprising the yellow toner of claim 1.

15. A toner cartridge in which the yellow toner of claim 1 is housed, the toner cartridge being attachable to and detachable from an image forming apparatus.

16. A process cartridge comprising a developing unit that houses the developing agent of claim 14, develops an electrostatic latent image formed on a surface of a latent image holding member by way of the developing agent so as to form a toner image, and is attachable to and detachable from an image forming apparatus.

17. An image forming apparatus comprising:

a latent image holding member, a charging unit that charges a surface of the latent image holding member, an electrostatic latent image forming unit that forms an electrostatic latent image on the surface of the latent image holding member, a developing unit that develops the electrostatic latent image with the developing agent of claim 14 to form a toner image, a transfer unit that transfers the toner image onto a recording medium, and a fixing unit that fixes the toner image on the recording medium.

18. A process for forming an image, comprising:

developing an electrostatic latent image with a plurality of toners to form a plurality of toner images with the plurality of toners, transferring the plurality of toner images onto a surface of a recording medium to form a superposed toner image comprising a plurality of layers, and fixing the superposed toner image to form an image, the plurality of toners comprising at least the yellow toner of claim 1 and a magenta toner comprising a carmine-based pigment as a colorant.

19. The yellow toner of claim 1, wherein the weight ratio of the C. I. Pigment yellow 180 to the carmine-based pigment is from about 1,000:1 to about 2,500:1.

* * * * *